US005546761A

United States Patent [19]

Matsuo et al.

[11] Patent Number: 5,546,761

[45] Date of Patent: Aug. 20, 1996

[54] RECEIVER-INTEGRATED REFRIGERANT CONDENSER

[75] Inventors: Hiroki Matsuo, Kariya; Yasushi Yamanaka, Nakashima-gun; Norimasa Baba, Nagoya; Michiyasu Yamamoto, Chiryu; Ken Yamamoto, Obu, all of Japan

[73] Assignee: Nippondenso Co., Ltd., Kariya, Japan

[21] Appl. No.: 389,185

[22] Filed: Feb. 15, 1995

[30] Foreign Application Priority Data

Feb. 16, 1994 [JP] Japan ..... 6-019254
Dec. 13, 1994 [JP] Japan ..... 6-308703

[51] Int. Cl.[6] ..... F25B 39/04; F28F 9/02

[52] U.S. Cl. ..... 62/509; 165/173

[58] Field of Search ..... 62/509; 165/173, 165/DIG. 471

[56] References Cited

U.S. PATENT DOCUMENTS 4,972,683 11/1990 Baetenbough ..... 62/507
5,224,358 7/1993 Yamanaka et al. ..... 62/509

FOREIGN PATENT DOCUMENTS 237287 2/1990 Japan .
2267478 11/1990 Japan .
3087572 4/1991 Japan ..... 62/509
6094330 4/1994 Japan ..... 62/509

*Primary Examiner*—William E. Wayner
*Attorney, Agent, or Firm*—Cushman, Darby & Cushman

[57] ABSTRACT

A communication chamber communicated with the downstream end of a condensing part is provided within a header. A gas-liquid separation chamber is provided beside the communication chamber for separating the refrigerant into gas and liquid phases. The height of this gas-liquid separation chamber is set to be smaller than that of the communication chamber to prevent the interference of the gas-liquid separation chamber with peripheral devices of a vehicle to facilitate the installation of the condenser. Further, a refrigerant introducing means is provided at a portion corresponding to a liquid refrigerant pool part at the lower part of the gas-liquid separation chamber within the partition part for introducing the refrigerant within the communication chamber into the liquid refrigerant within the gas-liquid separation chamber.

22 Claims, 15 Drawing Sheets

RECEIVER-INTEGRATED REFRIGERANT CONDENSER

CROSS REFERENCE TO RELATED APPLICATIONS

This application is based upon and claims priority from Japanese Patent Application No. 6-19254 filed Feb. 16, 1994 and Japanese Patent Application No. 6-308703 filed Dec. 13, 1994, with the contents of each document being incorporated herein by reference.

BACKGROUND OF THE INVENTION

1. Field of the Invention

The present invention generally relates to a receiver-integrated refrigerant condenser for use in a refrigerating cycle. More particularly, the present invention relates to a receiver-integrated refrigerant condenser which can suitably be applied to an automotive air conditioner in which the quantity of the circulating refrigerant greatly varies.

2. Related Art

In the refrigerating cycle of conventional automotive air conditioners, a receiver and a condenser are separately and independently disposed. Therefore, it is difficult to reduce the cost by reducing the number of parts and components. Furthermore, as the receiver and the condenser need the respective installation spaces, the requirement of reducing the installation space can not be fulfilled. To solve these problems with the conventional automotive air conditioners, U.S. Pat. No. 4,972,683 and Japanese Unexamined Patent Publication No. 2-267478 disclose that a gas-liquid refrigerant separation chamber functioning as a receiver is integrally formed at the header part on the outlet side of the condenser.

In the composition of the above examples, however, the widthwise dimension in the horizontal direction of the header part on the outlet side of the condenser is enlarged by integrally providing the gas-liquid separation chamber at the header part on the outlet side thereof.

Further in Japanese Unexamined Patent Publication No. 2-267478, the gas-liquid refrigerant separation chamber functioning as the receiver has an outlet opening upwards and the outlet connects an outlet pipe communicating with an evaporator. Therefore, the outlet pipe around the outlet of the gas-liquid refrigerant separation chamber occupies a further space between the header tank and the gas-liquid refrigerant separation chamber.

As a result, in installing each of the above condensers in an extremely narrow engine room of a vehicle, the header part and the gas-liquid refrigerant separation chamber including the outlet pipe may interfere with the vehicle body or other devices, causing difficulties to the installation.

In order to install the condenser in a limited space within the engine room, however, the widthwise dimension of the core for heat exchanging between the refrigerant in the condenser and the fresh air has to be reduced in some cases because of the enlarged width of the gas-liquid separation chamber. As a result, a problem may be caused that the performance of the condenser falls.

SUMMARY OF THE INVENTION

The present invention has an object to provide a receiver-integrated refrigerant condenser which has little interference between the header part thereof with peripheral devices of a vehicle even when the installation space is narrow.

Another object of the present invention is to provide a receiver-integrated refrigerant condenser which has a high gas-liquid separability of the refrigerant within a gas-liquid separation chamber even in such a composition that the gas-liquid separation chamber is integrally formed at the header part thereof.

In order to achieve the above object, a receiver-integrated refrigerant condenser of the present invention has a core having a condensing part for condensing a refrigerant flowing in a horizontal direction, a header extending in a vertical direction at one end of the core and connected to the downstream end of said condensing part, a communication chamber provided within the header and communicated with the downstream end of the condensing part, the gas-liquid separation chamber provided beside the communication chamber within the header for separating refrigerant into gas and liquid phases, the refrigerant introducing means for introducing the refrigerant within the communication chamber into the gas-liquid separation chamber, and the refrigerant discharging means disposed in a position lower than the refrigerant introducing means for discharging the refrigerant within the gas-liquid separation chamber therefrom, and further a vertical length of the gas-liquid separation chamber which is shorter than that of the communication chamber.

According to the present invention, the vertical length of the gas-liquid separation chamber is shorter than the vertical length of the combination of communication chambers. As a result, even in such a composition that a receiving part is integrally formed at the header of a condenser, the degree of interference of a receiving part with peripheral devices of a vehicle can substantially be reduced, whereby the receiver-integrated condenser can easily be installed. Accordingly, there is no need to reduce the widthwise dimension of the core having the condensing part and the condensing performance can easily be ensured.

Further in preferred embodiment, the refrigerant condensed by the condensing part is temporarily pooled within an upstream side communication chamber and then introduced into the gas-liquid separation chamber through the refrigerant introducing means in the partitioning part. In this arrangement, the gas refrigerant in a state of small bubbles discharged from the condensing part is collected within the upstream side communication chamber and become the gas refrigerant in a state of bubbles larger in diameter and greatly influenced by buoyancy. As a result, the refrigerant can easily be separated into gas and liquid phases within the gas-liquid separation chamber.

Furthermore, it is so arranged that the refrigerant flows from the refrigerant introducing means into the liquid refrigerant at the lower part of the gas-liquid separation chamber. Therefore, even when the flow rate of the refrigerant is large, the refrigerant level within the gas-liquid separation chamber is not rippled. As a result, the refrigerant can suitably be separated into gas and liquid phases.

DESCRIPTION OF THE PREFERRED EMBODIMENTS

A receiver-integrated refrigerant condenser according to the present invention will be described referring to preferred embodiments applied to an automotive air conditioner.

Figure 1:
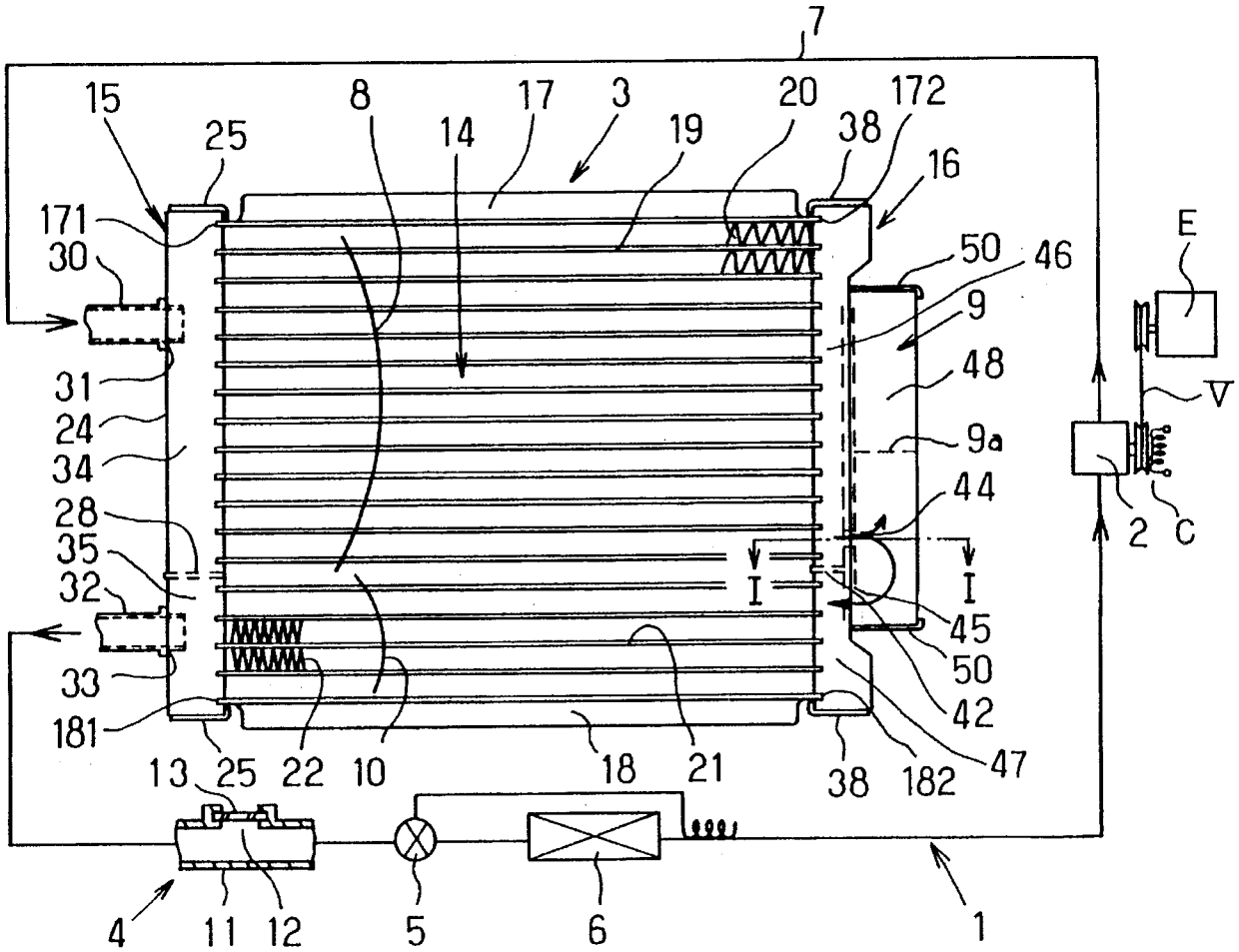
FIG. 1 is a construction view illustrating the refrigerating cycle of an automotive air conditioner applied to the first embodiment according to the present invention.

FIGS. 1 to 5 illustrate the first embodiment of the present invention. FIG. 1 illustrates a refrigerating cycle of an automotive air conditioner. This refrigerating cycle 1 of an automotive air conditioner comprises a refrigerant compressor 2, a receiver-integrated refrigerant condenser 3, a sight glass 4, an expansion valve 5 and a refrigerant evaporator 6, all of which being serially connected by a metal or rubber refrigerant pipe 7.

The refrigerant compressor 2 is connected to an engine E disposed within an engine room (not illustrated) of a vehicle through a belt V and an electromagnetic clutch (power transmission connecting/disconnecting means) C. When the rotational power of the engine E is transmitted to the refrigerant compressor 2, the refrigerant compressor 2 compresses the gas phase (gas) refrigerant sucked therein from the refrigerant evaporator 6 and then discharges the gas refrigerant which is high in temperature and pressure to the receiver-integrated refrigerant condenser 3.

The receiver-integrated refrigerant condenser 3 integrally includes a condensing part 8, a receiving part 9 and a supercooling part 10. The condensing part 8 connected to the discharge side of the refrigerant compressor 2 functions as a condensing means for condensing the gas refrigerant flowed thereinto from the refrigerant compressor 2 by heat exchanging the gas refrigerant with the fresh air delivered by a cooling fan (not illustrated) and other means.

The receiving part 9 functions as a gas-liquid separating means which separates the refrigerant flowed thereinto from the condensing part 8 into gas refrigerant and liquid refrigerant and supplies only the liquid refrigerant to the supercooling part 10. The supercooling part 10 disposed beneath the condensing part 8 disposed thereabove functions as a supercooling means for supercooling the liquid refrigerant flowed thereinto from the receiving part 9 by exchanging the heat of the liquid refrigerant with the fresh air delivered by the cooling fan and other means.

The sight glass 4 connected downstream from the supercooling part 10 of the receiver-integrated refrigerant condenser 3 functions as a refrigerant quantity monitoring means for monitoring the quantity of the refrigerant sealed within the refrigerating cycle 1 to check for the over—or short-supply of the refrigerant by observing the gas-liquid state thereof circulating through the refrigerating cycle 1. This sight glass 4 is independently provided in a place within the engine room of a vehicle where a checker can easily make a visual check, e.g., somewhere on the way in the refrigerant pipe 7 provided in adjacency to the receiver-integrated refrigerant condenser 3.

The sight glass 4 comprises a tubular metal body 11 connected at both ends to the refrigerant pipe 7 by means of welding or fastening, for example, and a deposited glass 13 fitted into a peephole 12 formed on the top of the metal body 11 as illustrated in FIG. 1. It is generally judged that if bubbles are found in the refrigerant through the peephole 12, the refrigerant should be short-supplied, and if bubbles are not found, the refrigerant should be properly supplied.

The expansion valve 5 connected to the side of the refrigerant inlet part of the refrigerant evaporator 6 functions as a pressure reducing means for turning the high pressure, high temperature refrigerant flowed thereinto from the sight glass 4 to the low temperature, low pressure atomized refrigerant in two gas and liquid by adiabatically expanding the refrigerant. In this embodiment, a thermostatic expansion valve is used which automatically controls the opening thereof to hold the superheat degree of the refrigerant at the refrigerant outlet part of the refrigerant evaporator 6 at the preset value.

The refrigerant evaporator 6 connected between the suction side of the refrigerant compressor 2 and the downstream side of the expansion valve 5 functions as a cooling means for cooling the blowing air by the latent heat of vaporization by heat exchanging the refrigerant in the gas and liquid flowed thereinto from the expansion valve 5 with the fresh air or recirculating air blown by a blower (not illustrated) and evaporating the refrigerant.

Next, this embodiment of the receiver-integrated refrigerant condenser 3 will be described in detail referring to FIGS. 2 to 5. The receiver-integrated refrigerant condenser 3 is about 300 mm to 400 mm in height and about 300 mm to 600 mm in width, for example. This receiver-integrated refrigerant condenser 3 is mounted to a vehicle body using a mounting bracket (not illustrated) so as to be positioned in a place which can easily receive the wind during the running of the vehicle within the engine room thereof normally at the front side of a radiator for cooling the engine cooling water. The receiver-integrated refrigerant condenser 3 comprises a core 14 as a heat exchanger, a first header 15 disposed at one horizontally distal end of the core 14 and a second header 16 disposed at the other horizontally distal end of the core 14.

All these components are made of aluminum integrally brazed within a furnace.

The core 14 comprises the condensing part 8 and the supercooling part 10. The upper and lower ends of the condensing part 8 and supercooling part 10 are joined to side plates 17 and 18 respectively by brazing or other joining method. These side plates 17 and 18 serve as mounting brackets for mounting the receiver-integrated refrigerant condenser 3 to the vehicle body. The condensing part 8 located above the supercooling part 10 comprises a plurality of horizontally extending condensing tubes 19 and a plurality of corrugated fins 20, both of which being joined to each other by brazing or other joining method. The supercooling part 10 located under the condensing part 8 comprises a plurality of horizontally extending supercooling tubes 21 and a plurality of corrugated fins 22, both of which being joined to each other by brazing or other joining method.

Figure 2:
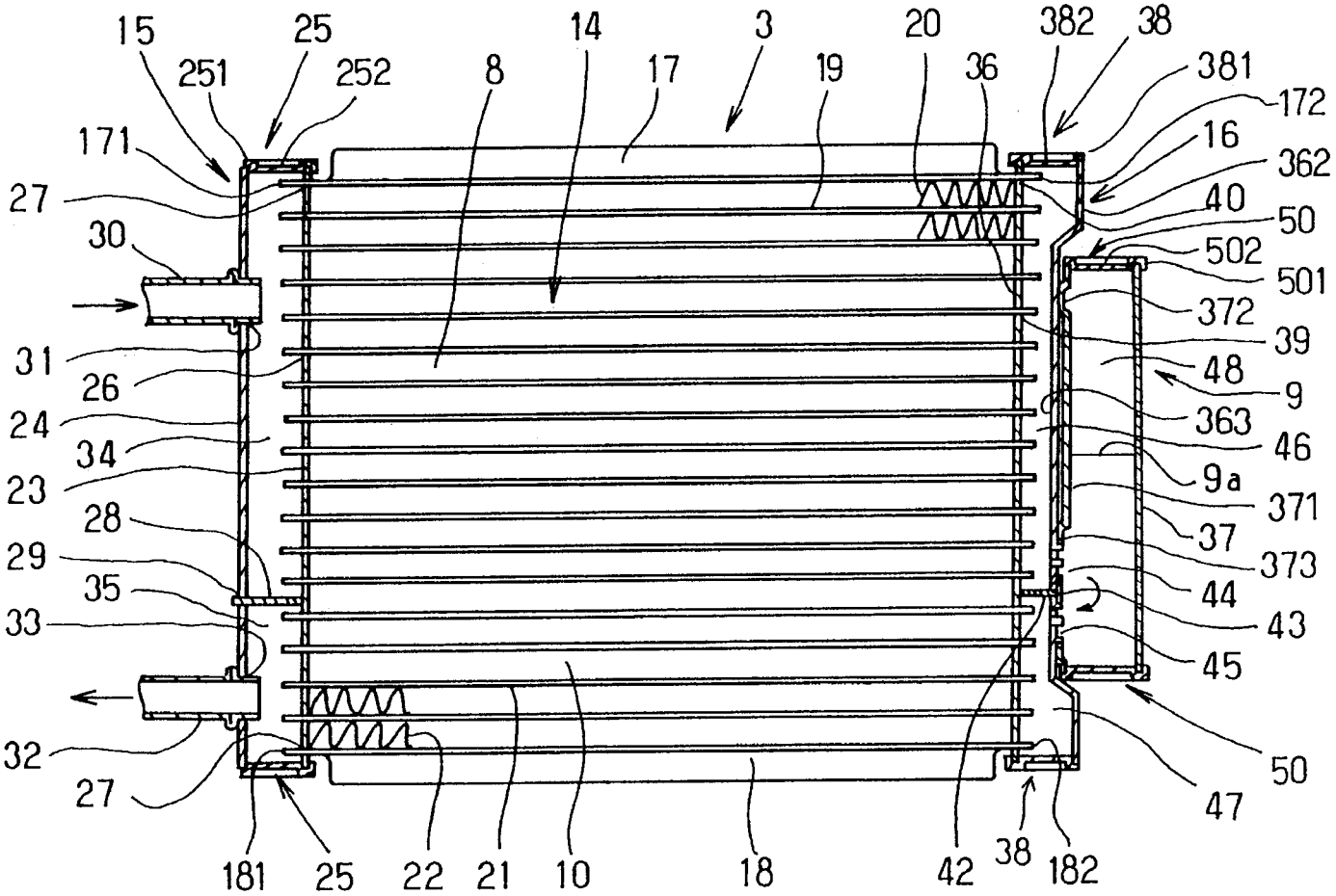
FIG. 2 is a cross-sectional view illustrating the receiver-integrated refrigerant condenser applied to the first embodiment according to the present invention.
Figure 3:
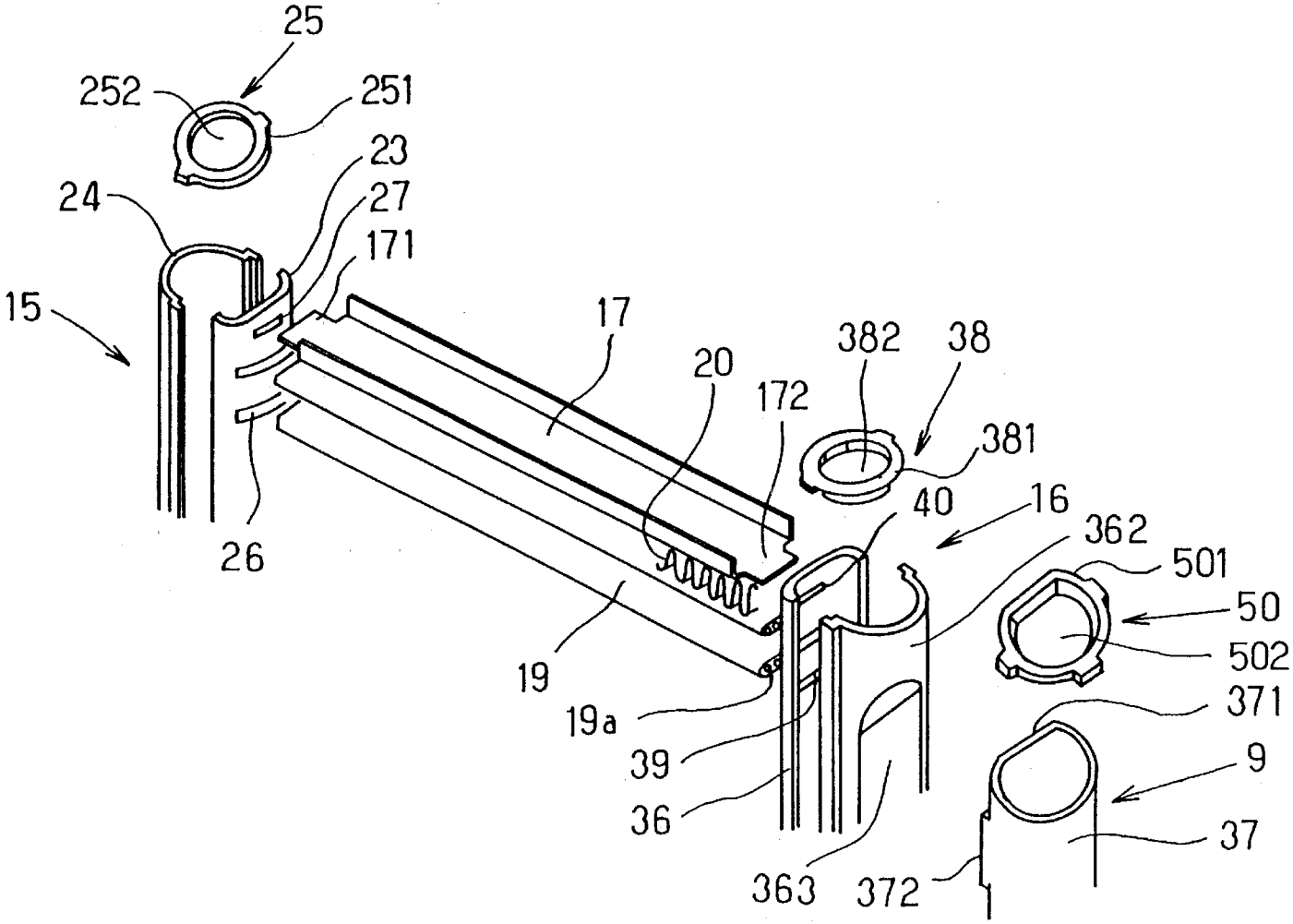
FIG. 3 is a partial exploded perspective view illustrating the receiver-integrated refrigerant condenser illustrated in FIG. 2.

The side plates 17 and 18 are formed into the specified shapes illustrated in FIGS. 2 and 3 by press working aluminum or aluminum alloy plates treated by cladding with wax. At both horizontally distal ends of the side plates 17 and 18 are formed tenons 171, 172, 181 and 182 to be inserted into the first header 15 and second header 16 respectively.

The plurality of condensing tubes 19 and supercooling tubes 21 which are refrigerant passage forming means are formed by extruding an aluminum or aluminum alloy material having a high corrosion resistance and a high heat conductivity into a shape having a flat elliptical cross section and containing a plurality of refrigerant passages **19*a* as illustrated in FIG. 3. The corrugated fins 20 and 22** which are a heat radiation facilitating means for improving the radiation efficiency of the refrigerant are formed by press working aluminum or aluminum alloy plates or other metal plate treated by cladding with wax on both sides into a corrugated shape.

The refrigerant flows from the first header 15 on the refrigerant inlet side through the plurality of condensing tubes 19 in the horizontal direction to the second header 16. On the other hand, the refrigerant flowing in the plurality of supercooling tubes 21 flows in the horizontal direction from the second header 16 to the first header 15. In this embodiment, the number of the condensing tubes 19 is larger that of the supercooling tubes 21. Empirically through experiments, it is preferable that the number of the supercooling tubes 21 should be about 15% to 20% of the total number of the cores 14.

The first header 15 which comprises a header plate 23 having a roughly U-shaped cross section and a tank plate 24 having a semi-arc cross section has a roughly cylindrical configuration extending in the vertical direction. Both the header plate 23 and the tank plate 24 composing the first header 15 are formed into the shape described above by press working a metal plate of aluminum or aluminum alloy having a high corrosion resistance and a high heat conductivity and treated by cladding with wax on both sides.

To the upper part of the first header 15 are connected the upstream ends (tenons) of the plurality of condensing tubes 19 composing the condensing part 8. On the other hand, to the lower part of the first header 15 are connected the downstream ends of the plurality of supercooling tubes 21 composing the supercooling part 10. To the opening parts at the upper and lower ends in the vertical direction (longitudinal direction) are fittingly covered with caps 25 respectively.

The cap 25 is formed into the shape illustrated in FIG. 3 by press working an aluminum or aluminum alloy plate treated by cladding with wax. This cap 25 includes a roughly circular joining part 251 to be joined to the upper/lower end of the first header 15 by brazing or other joining method and a disc-like blockading part 252 recessed from the level of the joining part 251 for blockading the opening at the upper/lower end of the first header 15.

In the header plate 23 are made by press working a multiplicity of elliptical punch holes 26 longitudinally arranged and through holes 27 at the upper and lower ends respectively. The multiplicity of punch holes 26 are joined by brazing or other joining method the upstream ends of the plurality of condensing tubes 19 and the downstream ends of the supercooling tubes 21 which are inserted therein. On the other hand, to the through holes 27 located at the upper and lower ends of the header plate 23 are joined by brazing or other joining method the tenons 171 and 181 of the side plates 17 and 18 respectively which are inserted therein.

In the tank plate 24 are made by press working a hole part 29 for fixing a separator 28 vertically partitioning the inside of the first header 15, a circular refrigerant suction opening 31 for fixing an inlet pipe 30 and a circular refrigerant discharge opening 33 for fixing an outlet pipe 32. The separator 28 formed into a roughly disc shape is designed to separate the inside of the first header 15 into an inlet side communication chamber 34 in communication only with the upstream end of the condensing part 8 and an outlet side communication chamber 35 in communication only with the downstream end of the supercooling part 10.

The inlet pipe 30 having a circularly tubular configuration is joined to the refrigerant suction opening 31 by brazing or other joining method for introducing the high temperature, high pressure gas refrigerant discharged from the refrigerant compressor 2 into the inlet side communication chamber 34. On the other hand, the outlet pipe 32 having a circularly tubular shape is joined to the refrigerant discharge opening 33 by brazing or other joining method for discharging the liquid refrigerant within the outlet side communication chamber 35 into the side of the sight glass 4.

Figure 4:
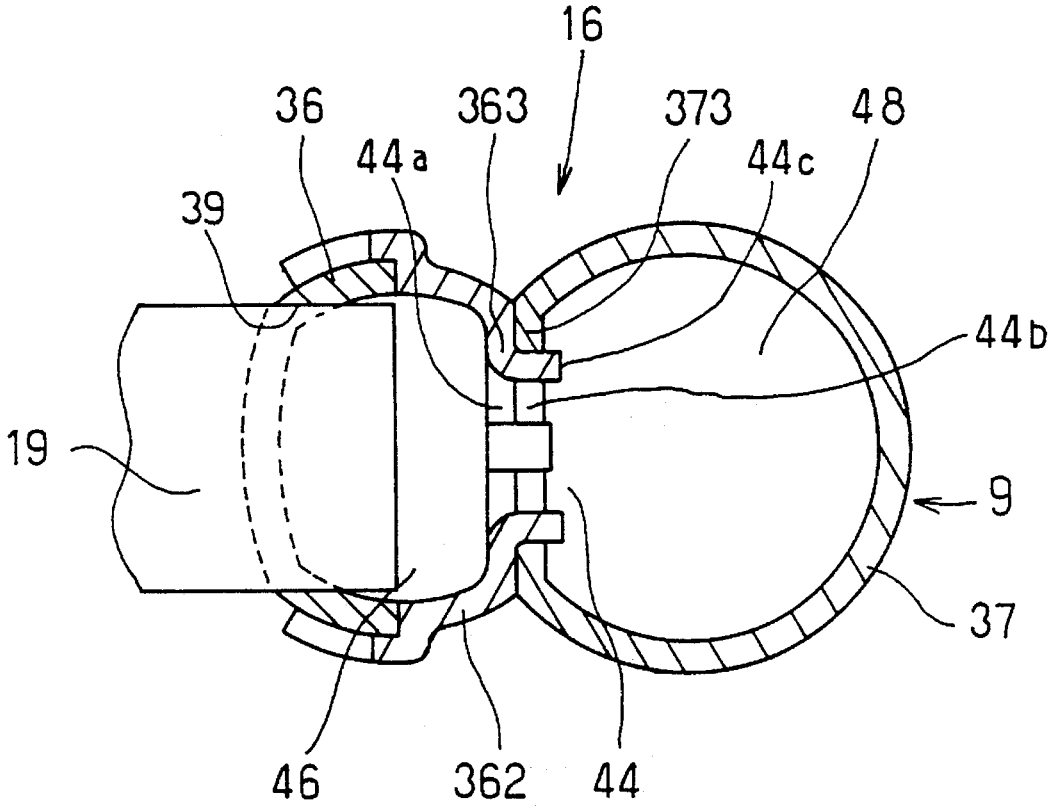
FIG. 4 is a cross-sectional view illustrating the second header illustrated in FIG. 2 taken along I—I of FIG. 1.
Figures 5A, 5B:
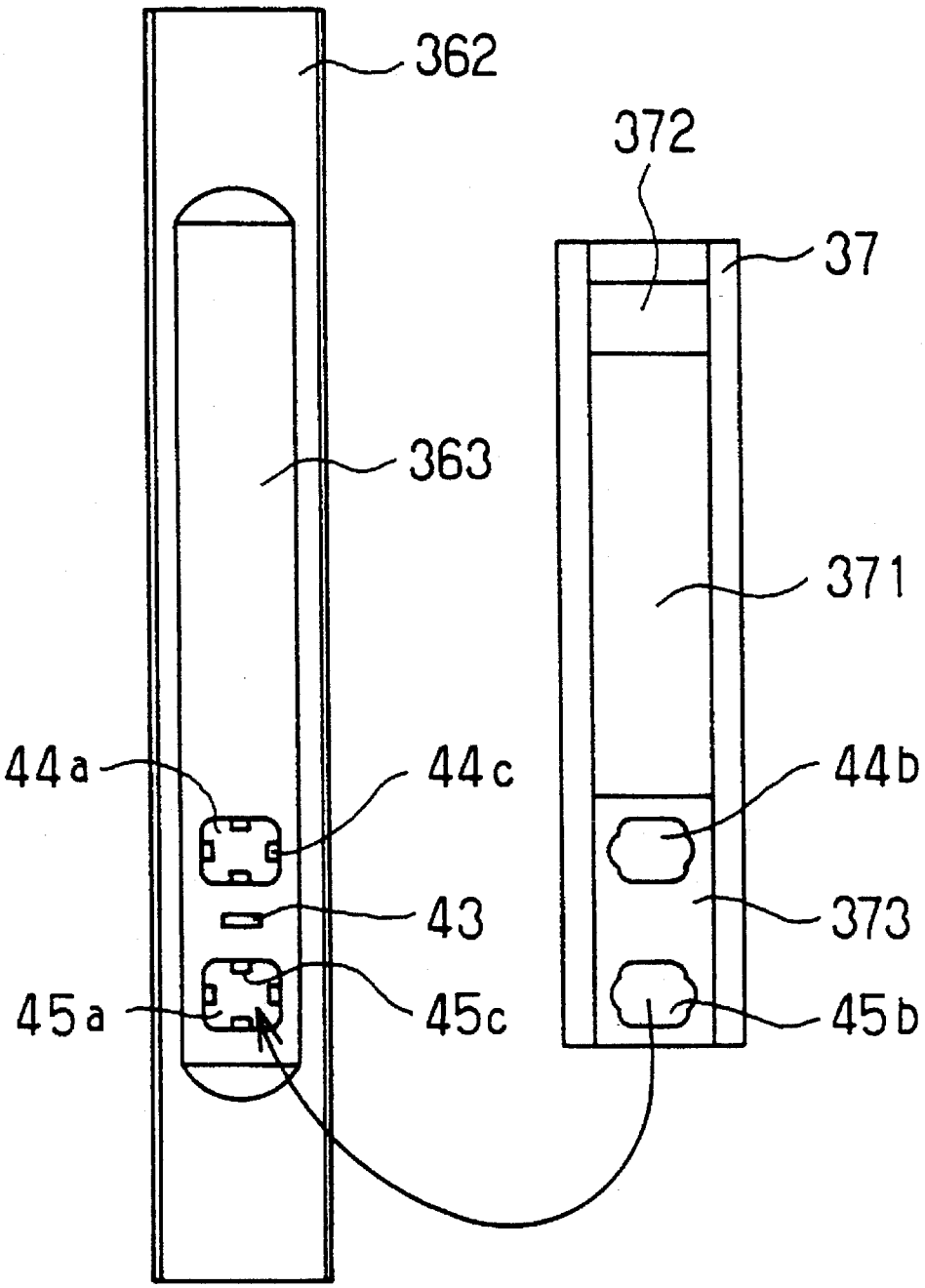
FIG. 5A is a front view illustrating the tank plate of the second header applied to the first embodiment.
FIG. 5B is a front view illustrating the cylindrical body of the second header applied to the first embodiment.

As specifically illustrated in FIGS. 3 and 4, the second header 16 comprises a header plate 36 having a roughly U-shaped cross section, a tank plate 362 having a roughly semi-arc cross section and a cylindrical body 37 having a roughly cylindrical shape. This second header 16 has a vertically extending double-cylinder configuration by combining these three components 36, 362 and 37. The second header 16 is formed into the shape described above by press working a metal plate of aluminum or aluminum alloy having a high corrosion resistance and a high heat conductivity.

To the upper part of the second header 16 are connected the downstream ends of the plurality of the condensing tubes 19 composing the condensing part 8. On the other hand, to the lower part of the second header 16 are connected the upstream ends of the plurality of supercooling tubes 21 composing the supercooling part 10. To the opening parts at the upper and lower ends in the vertical direction (longitudinal direction) of the cylindrical space of the second header 16 composed by the header plate 36 and the tank plate 362 are fitted caps 38 respectively.

The cap 38 includes a roughly circular joining part 381 to be joined to the upper/lower end of the above cylindrical space by brazing or other joining method and a disc-like blockading part 382 recessed from the level of the joining part 381 for blockading the opening on the inside of the upper/lower end of the cylindrical space. This cap 38 is formed into the shape illustrated in FIG. 3 by press working an aluminum plate treated by cladding with wax in the same way as the above cap 25.

In the header plate 36 are made by press working a multiplicity of elliptical punch holes 39 longitudinally arranged and a through hole 40 at the upper and lower ends respectively. The multiplicity of punch holes 26 are joined by brazing or other joining method the downstream ends of the plurality of the condensing tubes 19 and the upstream ends of the plurality of supercooling tubes 21 which are inserted therein. To the through holes 40 are joined by brazing or other joining method the tenons 172 and 182 of the side plates 17 and 18 respectively which are inserted therein.

The cylindrical body 37 is formed by extruding an aluminum material into a cylindrical shape having a flat part 371 on the face facing the tank plate 362. In the same way, on the tank plate 362 is formed by press working a flat part 363 on the face facing the cylindrical body 37. These flat parts 363 and 371 are designed to prevent the second header 16 from transversely (horizontally) shifting and secure the brazing area between the cylindrical body 37 and the tank plate 362.

FIGS. 4 and 5 illustrate in detail the structure of the cylindrical body 37 and tank plate 362 joined by brazing. In this embodiment, in the upper and lower positions of the flat part 371 of the cylindrical body 37 are formed by press working flat protruding parts 372 and 373 protruding one step from the flat part 371. These protruding parts 372 and 373 are used as brazing faces for braze the cylindrical body 37 to the tank plate 362. The purpose of providing these protruding parts 372 and 373 for brazing is to secure a higher brazing strength for the reason as described below in detail.

If the entire areas of the flat parts 363 and 371 are used for brazing, which is possible though, it would be difficult to achieve uniform brazing throughout the flat areas 363 and 371 as the flux applied thereto for brazing may be uneven in thickness or the clearance caused to the joined faces may be uneven in size, which may result in defective brazing (i.e., void). By providing the flat protruding parts 372 and 373 on the flat part 371 of the cylindrical body 37 in this embodiment, the areas around the protruding parts 372 and 373 are not brazed. In brazing, therefore, the wax material flows to the protruding parts 372 and 373 forming contact faces. At the same time, the flux can easily stay on the protruding parts 372 and 373, and the wax on these protruding parts 372 and 373 can be easily activated. Consequently, complete brazing faces secured on the protruding parts 372 and 373 are obtained. Furthermore, by providing a plurality of protruding parts (2 pieces at the upper and lower parts in this embodiment), a higher strength at a brazed face can be achieved.

In the above embodiment, the protruding parts 372 and 373 are provided on the flat part 371 of the cylindrical body 37. Instead of these protruding parts 372 and 373, a plurality of protruding parts may be provided on the flat part 363 of the tank plate 362 to improve the brazed face strength.

On the other hand, the cylindrical space formed by the header plate 36 and the tank plate 362 is vertically partitioned by the disc-like separator 42 to form a communication chamber 46 on the upstream side and a communication chamber 47 on the downstream side. Beside (outside) both the communication chambers 46 and 47 is located the cylindrical body 37. Within the cylindrical body 37 is formed the gas-liquid separation chamber 48 composing the receiving part 9.

The upstream side communication chamber 46 communicates only with the downstream end of the condensing part 8, while the downstream side communication chamber 47 communicates only with the upstream end of the supercooling part 10. The upstream side communication chamber 46 communicates with the portion below a refrigerant level **9*a* of the gas-liquid separation chamber 48 (normally, the refrigerant level 9*a* is the level of the refrigerant when the amount of the refrigerant sealed in the cycle is proper), which is a liquid refrigerant pool portion within the liquid-gas separation chamber 48, through a roughly rectangular refrigerant inlet opening 44 provided near the bottom part thereof (the lowest part of the condensing part 8). Furthermore, the gas-liquid separation chamber 48 communicates with the downstream side communication chamber 47 through a roughly rectangular refrigerant outlet opening 45 provided near the bottom part thereof. In other words, the refrigerant outlet opening 45 is disposed in a position lower than the refrigerant inlet opening 44**.

The separator 42 is formed into a disc-like shape by press working an aluminum plate treated by cladding with wax. This separator 42 is press fitted into a hole 43 made in the tank plate 362 and temporarily fixed thereto and then joined to the header plate 36 and the tank plate 362 by brazing.

The refrigerant inlet opening 44 and the refrigerant outlet opening 45 are composed of holes **44*a* and 45*a* and holes 44*b* and 45*b* made in the tank plate 362 and the cylindrical body 37 respectively. On the periphery of the holes 44*a* and 45*a* of the tank plate 362 are integrally formed a plurality of (4 pieces in this embodiment) claws 44*c* and 45*c*. In this arrangement, these claws 44*c* and 45*c* are press fitted into the inner periphery of the holes 44*b* and 45*b* to temporarily fix the tank plate 362 and the cylindrical body 37** before brazed.

The openings at the upper and lower ends of the cylindrical body 37 are blockaded by caps 50. Like the caps 25 and 38 described above, the cap 50 has a roughly annular joining part 510 to be joined to the upper/lower end of the cylindrical body 37 by brazing or other joining method and a roughly disc-like blockading part 502 recessed from the level of the joining part 501 for blockading the opening inside the upper/lower end of the cylindrical body 37. The cap 50 is formed into the shape as illustrated in FIG. 3 by press working an aluminum plate treated by cladding with wax.

The refrigerant inlet opening 44 opened at the lower part of the upstream side communication chamber 46 (the lowest part of the condensing part 8) is a refrigerant introducing means for introducing the refrigerant in the upstream side communication chamber 46 into the liquid refrigerant pool portion located below the liquid level **9*a* in the gas-liquid separation chamber 48. On the other hand, the refrigerant outlet opening 45 opened in the lower position than the refrigerant inlet opening 44 is a refrigerant discharging means for discharging the refrigerant in the gas-liquid separation chamber 48 to the downstream side communication chamber 47. The gas-liquid separation chamber 48 separates the refrigerant flowing thereinto from the upstream side communication chamber 46 into gas refrigerant and liquid refrigerant and discharges only the liquid refrigerant to the downstream communication chamber 47. Also in this embodiment, the flat part 363 of the tank plate 362 and the flat part 373 of the cylindrical body 37 jointly compose a partitioning part for partitioning the communication chamber 46 and 47 from the gas-liquid separation chamber 48**.

In this embodiment, as illustrated in FIGS. 1, 2 and 5, it is so arranged that the upper end of the gas-liquid separation chamber 48 is lower than the upper end of the communication chambers 46 and 47 as a unit and the lower end of the gas-liquid separation chamber 48 is higher than the lower end of the communication chambers 46 and 47 as a unit. Accordingly, the longitudinal length of the gas-liquid separation chamber 48 is shorter than that of the communication chambers 46 and 47 as a unit.

Now, the operation mode of the refrigerating cycle 1 of the first embodiment of an automotive air conditioner will be described referring to FIGS. 1 and 2. When the operation of the automotive air conditioner starts, the electromagnetic clutch C is electrically energized and the refrigerant compressor 2 is driven to rotate by the engine E through the belt V and the electromagnetic clutch C.

Then, the high temperature, high pressure gas refrigerant compressed in the refrigerant compressor 2 and discharged therefrom flows through the inlet pipe 30 into the inlet side communication chamber 34 of the first header 15. The gas refrigerant flowed into the inlet side communication chamber 34 is distributed into the plurality of condensing tubes 19 composing the condensing part 8 in the inlet side communication chamber 34.

The gas refrigerant distributed into the plurality of condensing tubes 19 passes through the condensing tube 19 and concurrently heat exchanged with the fresh air through the corrugated fins 20 to be condensed and liquefied. Most gas refrigerant is liquefied in this process and some remaining in the gas phase. The refrigerant flowed from the plurality of the condensing tubes 19 into the upstream side communication chamber 46 of the second header 16 is temporarily pooled within the upstream side communication chamber 46. Then, the refrigerant is discharged through the refrigerant inlet opening 44 opened at the lower part of the upstream side communication chamber 46 into the receiving part 9. In this arrangement, the gas refrigerant seen in the state of small bubbles flowed out of the downstream ends of the plurality of condensing tubes 19 is collected within the upstream side communication chamber 46. As the collected small bubbles of the gas refrigerant join together to form bubbles larger in diameter, the gas refrigerant is increasingly influenced by buoyancy.

The refrigerant flowed into the upstream side communication chamber 46 flows though the refrigerant inlet opening 44 into the liquid refrigerant below the refrigerant level **9*a* within the receiving part 9 (gas-liquid separation chamber 48). By designing the receiving part 9 (gas-liquid separation chamber 48**) with a considerably large cross-sectional area (e.g., 500 $mm^2$), the flow rate of the refrigerant is reduced and the refrigerant is separated into gas and liquid by using the buoyancy of the gas refrigerant in a state of bubbles.

Furthermore, as it is so arranged that the refrigerant flows from the upstream side communication chamber 46 through the inlet opening 44 into the liquid refrigerant at the lower part in the gas-liquid separation chamber 48, the surface of the refrigerant level **9*a* is not rippled by the refrigerant flowing into in the gas-liquid separation chamber 48. As a result, the refrigerant can more suitably be separated into gas and liquid. Particularly, even when the circulating amount of the refrigerant is large in a high-speed operation of the refrigerant compressor 2, the surface of the refrigerant level 9*a* is not rippled. Therefore, the gas-liquid separation can satisfactorily be performed, whereby a stable gas-liquid interface can be achieved within the receiving part 9**.

In addition, the second separator 42 is provided to elongate the passage from the downstream end of the lowest condensing tube 19 among of all the plurality of the condensing tubes 19 to the upstream end of the highest supercooling tube 21 among of all the plurality of supercooling tubes 21 to facilitate the gas-liquid separation by buoyancy.

Furthermore, the second separator 42 is provided so that the refrigerant flowed from the plurality of condensing tubes 19 into the second header 16 can make a U-turn and flows out into the plurality of supercooling tubes 21. In this arrangement, the gas refrigerant in a state of small bubbles flowed out of the downstream ends of the condensing tubes 19 is temporarily collected within the upstream side communication chamber 46 as described above. The small bubbles then join together and become bubbles larger in diameter and more susceptible to buoyancy. Subsequently, the gas refrigerant is separated into gas and liquid phases by centrifugal force, whereby the gas refrigerant in bubbles is increasingly concentrated (on the inside).

That is, the refrigerant inlet opening 44 is open at the lower part of the upstream side communication chamber 46 and even in the arrangement that the refrigerant inlet opening 44 is positioned in relative proximity to the refrigerant outlet opening 45, the refrigerant containing bubbles is subjected to the centrifugal force caused by the U-turn flow (vector in the opposite direction) when passing through the refrigerant inlet opening 44, the receiving part 9 and the refrigerant outlet opening 45 serially. As a result, the liquid refrigerant with a large specific gravity is driven to the outside of the cylindrical body 37, while the gas refrigerant in a state of small bubbles with a small specific gravity concentrates at the protruding parts within the receiving part 9 of the second separator 42.

When the refrigerant is separated into gas and liquid phases by centrifugal force and the gas refrigerant in a state of bubbles concentrates more, the bubbles join together into bubbles larger in diameter and the gas refrigerant is increasingly subjected to buoyancy, resulting in easier separation into gas and liquid phases. Accordingly, when the refrigerant flows from the refrigerant inlet opening 44 into the receiving part 9, the refrigerant can easily be separated into gas and liquid phases. As a result, the gas refrigerant pools at the upper part of the receiving part 9, while the liquid refrigerant pools at the lower part thereof.

In this arrangement, there is no case where the gas refrigerant in a state of bubbles which has not been separated from the liquid refrigerant is flowed from the receiving part 9 into the plurality of supercooling tubes 21. As a result, the supercooling part 10 can effectively be operated.

Furthermore, as the supercooling part 10 is located on the downstream side from the receiving part 9, even if the gas-liquid separation has not completely been achieved within the receiving part 9, the gas refrigerant in a state of bubbles can completely become extinct within the supercooling part 10. Therefore, the volume of the receiving part 9, or the cross-sectional area of the receiving part 9, can be reduced and the reduction in the effective radiation area of the condensing part 8 and supercooling part 10 of the core 14 can be prevented.

With all the above arrangements combined, the refrigerant in gas and liquid phases can effectively be separated into gas and liquid phases within the receiving part 9. The gas refrigerant pools at the upper part of the receiving part 9, while the liquid refrigerant pools at the lower part thereof. For this reason, if the refrigerating cycle 1 is filled with a sufficient quantity of refrigerant enough to make a gas-liquid interface in the receiving part 9, only the liquid refrigerant having no supercooling degree can flow from the refrigerant outlet opening 45 located at the lower part of the receiving part 9 into the downstream side communication chamber 47.

The liquid refrigerant flowed into the downstream side communication chamber 47 is distributed to the plurality of supercooling tubes 21 composing the supercooling part 10.

The liquid refrigerant distributed to the plurality of supercooling tubes 21 is heat exchanged with the fresh air through the corrugated fins 22 and supercooled when passing the supercooling tubes 21. Thus the supercooled liquid refrigerant becomes liquid refrigerant with a supercooling degree and flows into the outlet side communication chamber 35 of the first header 15.

The liquid refrigerant flowed into the outlet side communication chamber 35 flows through the outlet pipe 32 and sight glass 4 into the expansion valve 5. When supercooled liquid refrigerant flows into the expansion valve 5, the dryness of the refrigerant after pressure reduction within the expansion valve 5 falls, whereby the difference in refrigerant enthalpy between the inlet and outlet of the refrigerant evaporator 6 increases. As a result, the cooling capacity of an automotive air conditioner can be improved.

Moreover, the arrangement that the longitudinal length of the gas-liquid separation chamber 48 is shorter than that of the communication chambers 46 and 47 as a unit is extremely advantageous in practical application to the installation of the refrigerant condenser 3 in front of the radiator within the narrow engine room of a vehicle. In many cases, the front part of a vehicle ahead of the radiator has a curved design in both the vertical and horizontal directions for reasons of streamlining design, etc. Therefore, it is desirable that the widthwise dimension (horizontal dimension) of the refrigerant condenser 3 should be minimized to prevent the interference with peripheral components including the vehicle body. For this purpose, the vertical length of the gas-liquid separation chamber 48 is made shorter than that of the communication chambers 46 and 47 in a unit. Therefore, even if the width of the refrigerant condenser 48 is increased by the width of the gas-liquid separation chamber 48, the interference of the gas-liquid separation chamber 48 with the vehicle body, for example, can effectively be prevented because spaces are disposed at at least two corners of the receiving part 9 side of the refrigerant condenser 3. As a result, the refrigerant condenser 3 can easily be installed within the engine room.

In addition, as the receiver-integrated refrigerant condenser 3 is connected between the refrigerant compressor 2 and the sight glass 4, the cost can be reduced due to a smaller number of parts and components in comparison with the case where the receiver is independently installed. The space within the engine room of a vehicle for installing the receiver can also be saved.

Also in this embodiment, as the sight glass 4 is connected on the downstream side from the supercooling part 10, there is no need to achieve complete gas-liquid separation at the receiving part 9. That is, the volume of the receiving part 9, or the cross-sectional area of the receiving part 9, may as much as the allowance for the variation in the refrigerant quantity due to the variation in loads of the refrigerating cycle 1 and the leak of the refrigerant.

(Second Embodiment)

Figure 6:
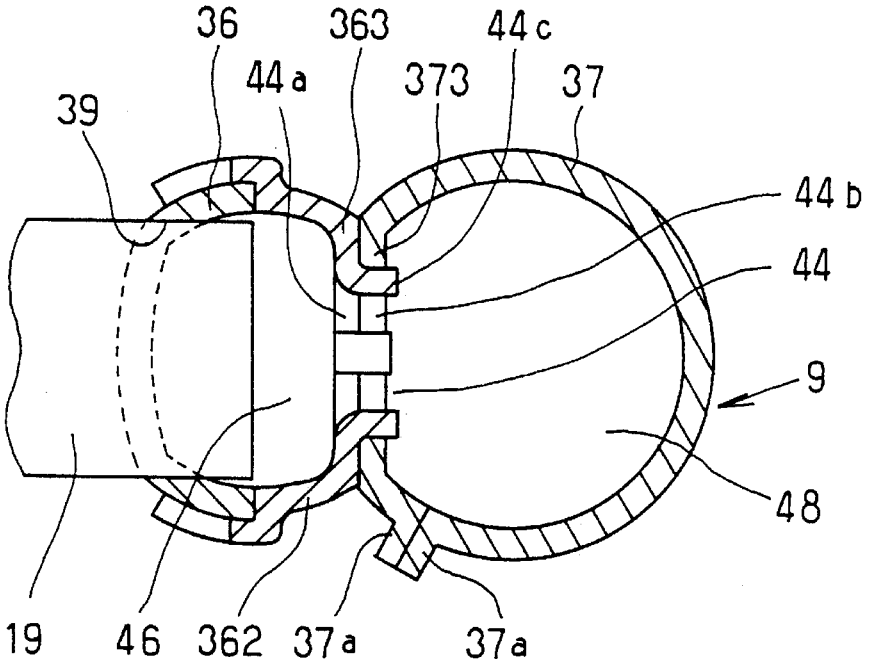
FIG. 6 is a cross-sectional view illustrating the second embodiment according to the present invention in correspondence to FIG. 4.

FIG. 6 is a cross-sectional view of a main part of the second embodiment according to the present invention in correspondence to FIG. 4. In this embodiment, the cylindrical body 37 is formed into a cylindrical shape having a flat part 371 by bending an aluminum plate or other metal plate treated by cladding with wax on both sides instead of extruding a metal plate and flat bending end parts 37*a* made of the metal plate are joined to each other by brazing. Other arrangements are the same as those in the first embodiment.

(Third Embodiment)

Figure 7:
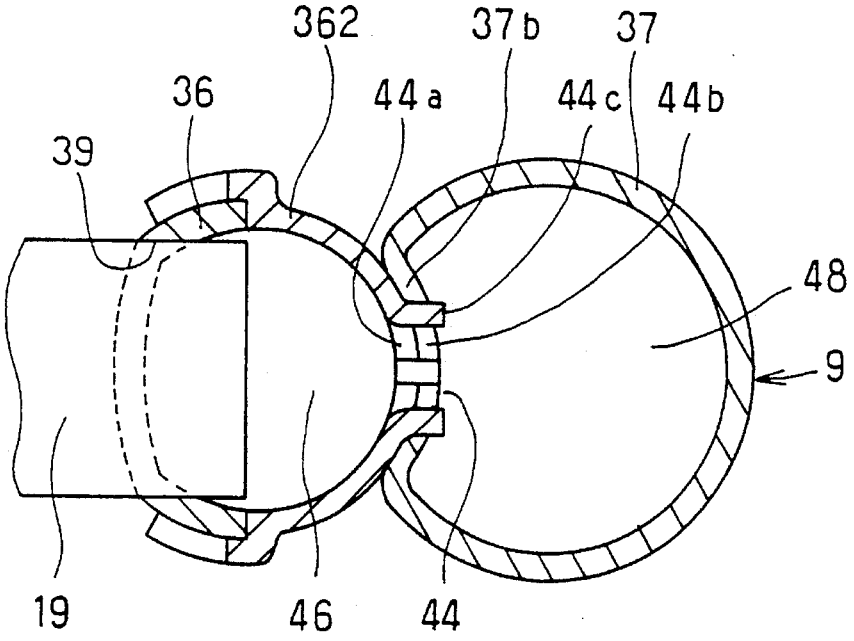
FIG. 7 is a cross-sectional view illustrating the third embodiment according to the present invention in correspondence to FIG.4.

FIG. 7 illustrates the third embodiment according to the present invention. In the above second embodiment, the tank plate 362 and the cylindrical body 37 have the flat parts 363 and 371 respectively formed by press working and the tank plate 362 and the cylindrical body 37 are joined with each other by brazing at the respective flat parts 373 and 371. In the third embodiment illustrated in FIG. 7, however, a recessed part 37*b* having an arc-like cross section is formed only on either one of the tank plate 362 or the cylindrical body 37 (on the cylindrical body 37, for example, in this description) by press working. Then, the recessed part 37*b* is closely contacted to the arc-like outer periphery of the tank plate 362, and then the cylindrical body 37 are joined with each other by brazing.

Of course, it is also acceptable that a recessed part having an arc-like cross section is formed on the tank plate 362 instead of the cylindrical body 37, the recessed part is closely contacted to the arc-like outer periphery of the cylindrical part 37, and then the tank plate 362 and the cylindrical body 37 are joined by brazing. Also in the second embodiment illustrated in FIG. 6, it is also acceptable that a recessed part having an arc-like cross section is formed on either of the cylindrical body 37 or the tank plate 362 and joining of the cylindrical body 37 and tank body 362 with each other is made at this arc-like part instead of brazing at the flat parts.

(Fourth Embodiment)

Figure 8:
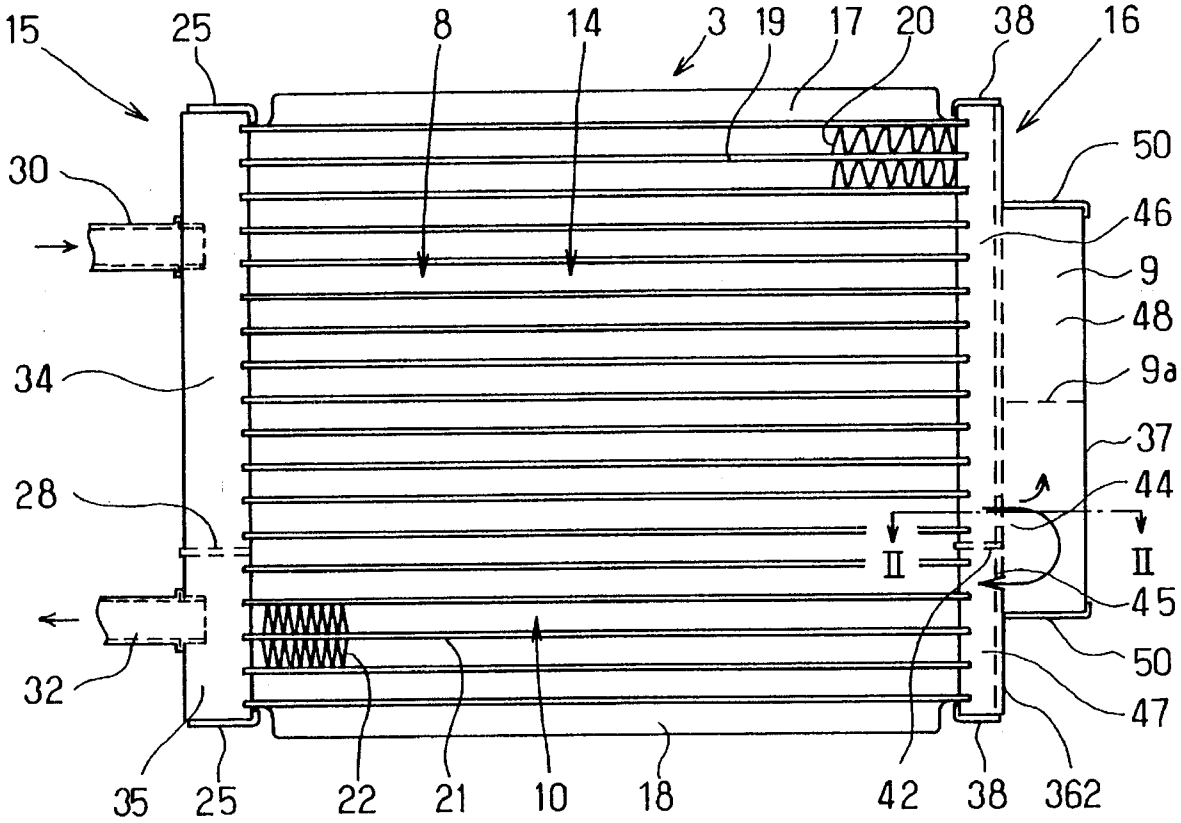
FIG. 8 is a front view of the condenser illustrating the fourth embodiment according to the present invention.
Figure 9:
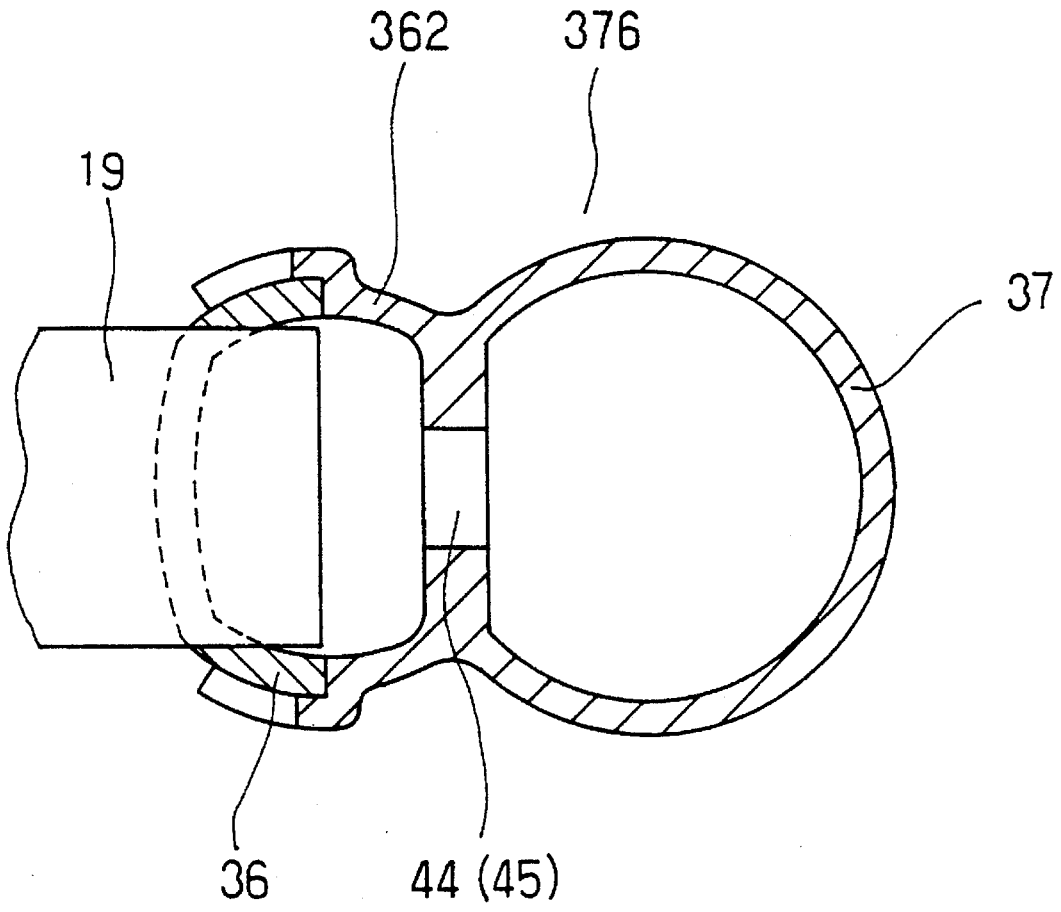
FIG. 9 is a cross-sectional view taken along II—II of FIG. 8.
Figure 10:
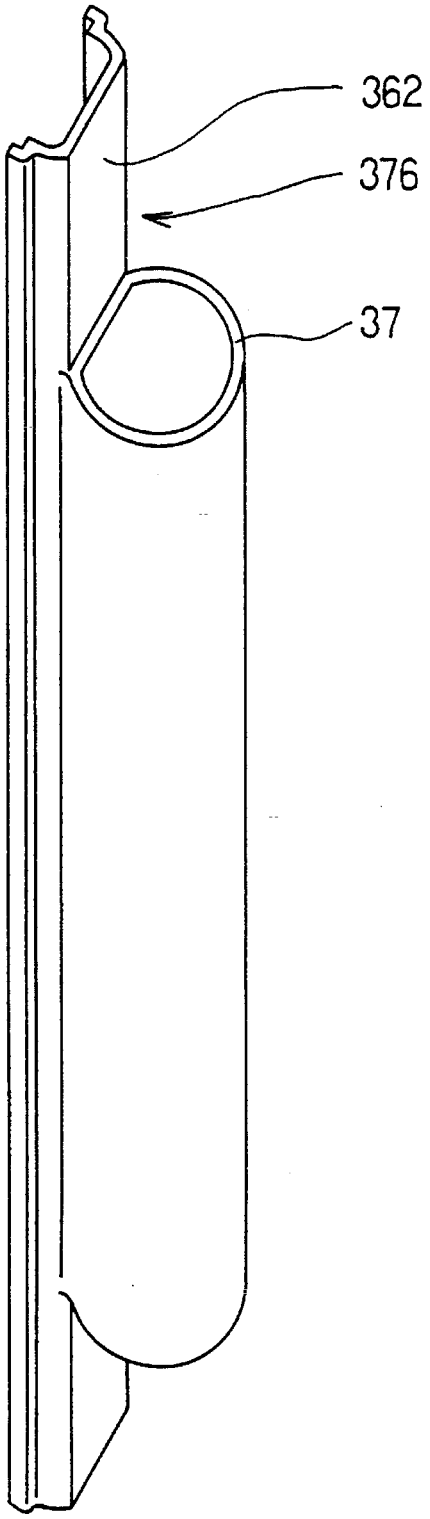
FIG. 10 is a perspective view illustrating the cylindrical part 376 illustrated in FIGS. 8 and 9.

FIGS. 8 through 10 illustrate the fourth embodiment according to the present invention. In this embodiment, the tank plate 362 and the cylindrical body 37 are integrally formed as a cylindrical part 376 by extruding an aluminum material. Then, the cylindrical body 37 is cut out at the upper and lower end thereof to form the cylindrical body 37 to a desired height as illustrated in FIG. 10. The holes composing the refrigerant passages 44 and 45 are formed by press working, drilling or other machining in the secondary process.

(Fifth Embodiment)

Figure 11A:
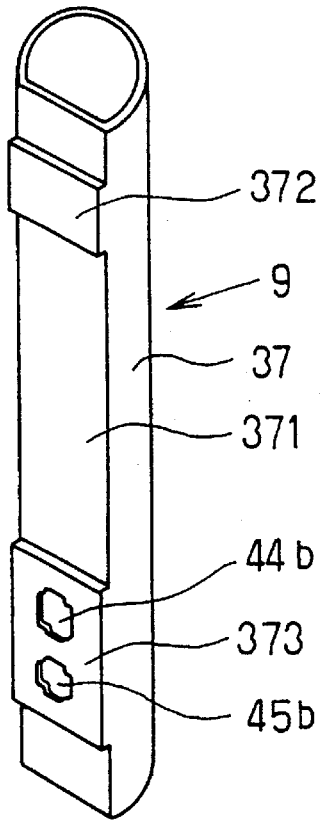
FIG. 11A is a perspective view illustrating the cylindrical body of the fifth embodiment according to the present invention.

FIGS. 11A and lib illustrate the fifth embodiment according to the present invention. In this embodiment, the cylindrical body 37 is the same as that illustrated in FIG. 5B. However, the header plate 36 and the tank plate 362 are integrally formed as a cylindrical part 365 by press working an aluminum plate or other metal plate treated by cladding with wax on both sides into a cylindrical shape. Flat bending end parts 365*a* of the metal plate are joined to each other by brazing. The flat part 363 is formed on the tank plate 362. This flat part 363 includes holes (not illustrated) composing the refrigerant passages 44 and 45 communicated with holes 44*b* and 45*b* in the cylindrical body 37. All the other arrangements are the same as those in the first embodiment.

(Sixth Embodiment)

Figure 12:
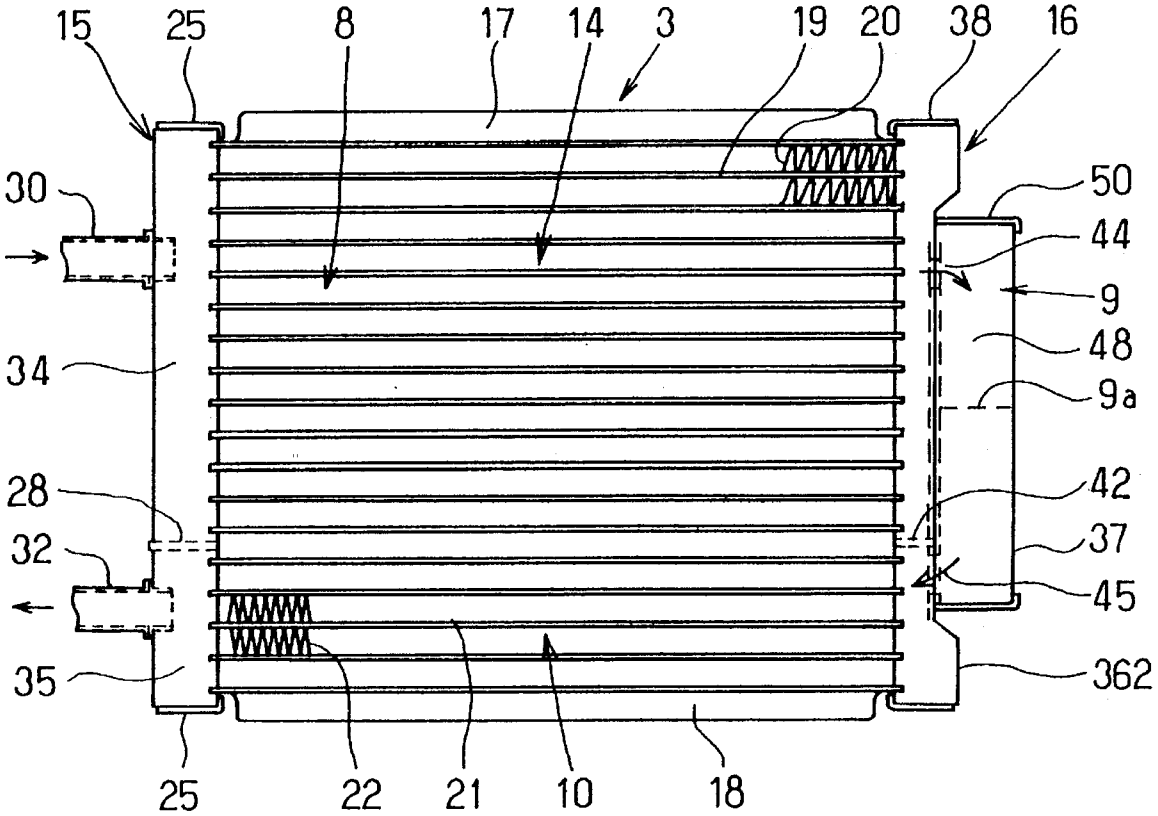
FIG. 12 is a front view illustrating the condenser of the sixth embodiment according to the present invention.

FIG. 12 illustrates the sixth embodiment according to the present invention. Unlike the first embodiment illustrated in FIG. 1, the refrigerant inlet opening 44 is positioned at the upper part of the gas-liquid separation chamber 9, i.e., above the refrigerant level 9*a*, so that the refrigerant condensed by the condensing part 8 flows from the inlet opening 44 into the gas refrigerant in the upper part of the gas-liquid separation chamber 9. All the other arrangements are the same as those in the first embodiment.

(Seventh Embodiment)

Figure 13:
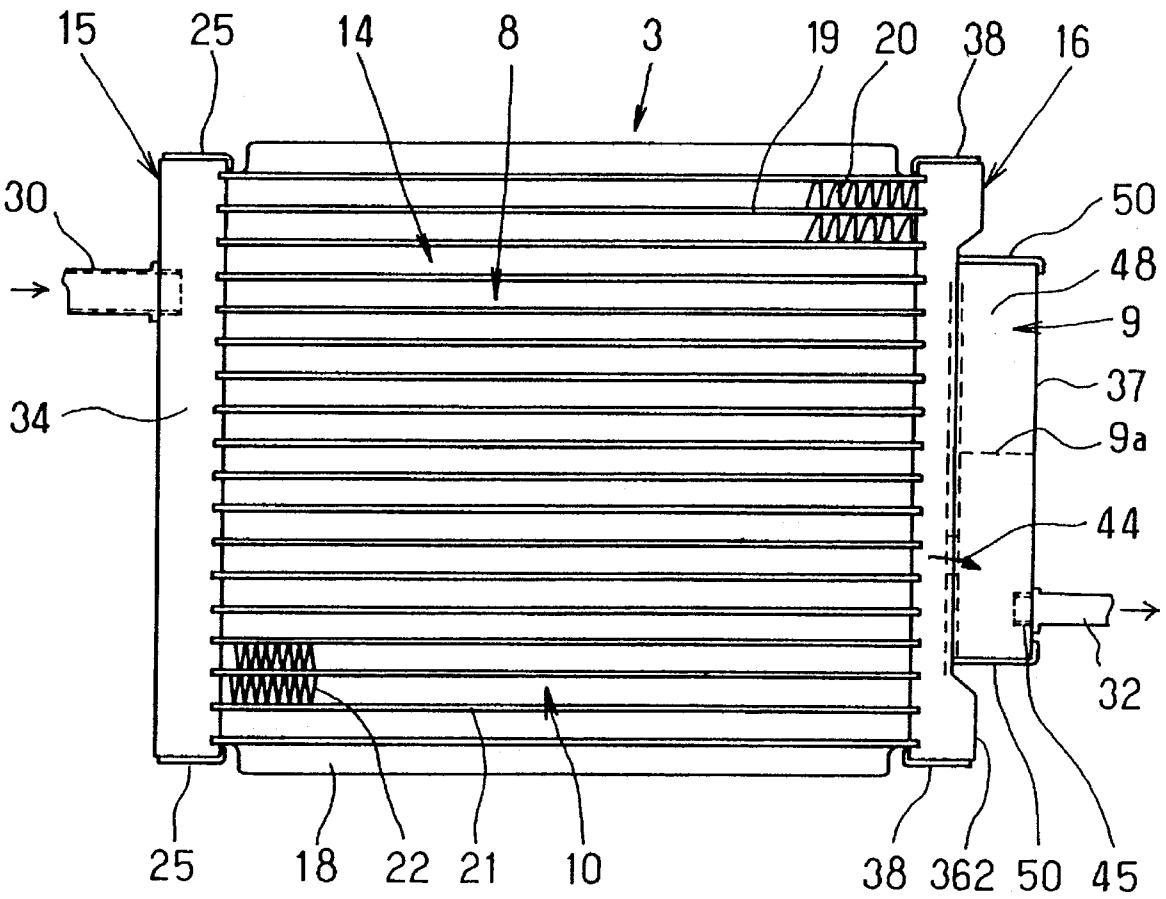
FIG. 13 is a front view illustrating the condenser of the seventh embodiment according to the present invention.

FIG. 13 illustrates the seventh embodiment according to the present invention, in which the supercooling part 10 provided in the first embodiment illustrated in FIG. 1 is not provided. In this embodiment, the whole heat-exchanging part of the refrigerant condenser 3 is composed as a condensing part 8. The refrigerant condensed by the condensing part 8 flows from the refrigerant inlet opening 44 positioned below the refrigerant level 9*a* of the gas-liquid separation chamber a into the liquid refrigerant in the gas-liquid separation chamber 9. The outlet pipe 32 is joined by brazing to the cylindrical body 37 composing the gas-liquid separation chamber 9 in the position lower than the refrigerant inlet opening 44. The inlet end of the outlet pipe 32 is opened in the gas-liquid separation chamber 9 to form the refrigerant outlet opening 45. In this arrangement, the liquid refrigerant in the gas-liquid separation chamber 9 can flow from the outlet pipe 32 directly to the outside to the side of the sight glass 4.

(Eighth Embodiment)

Figure 14:
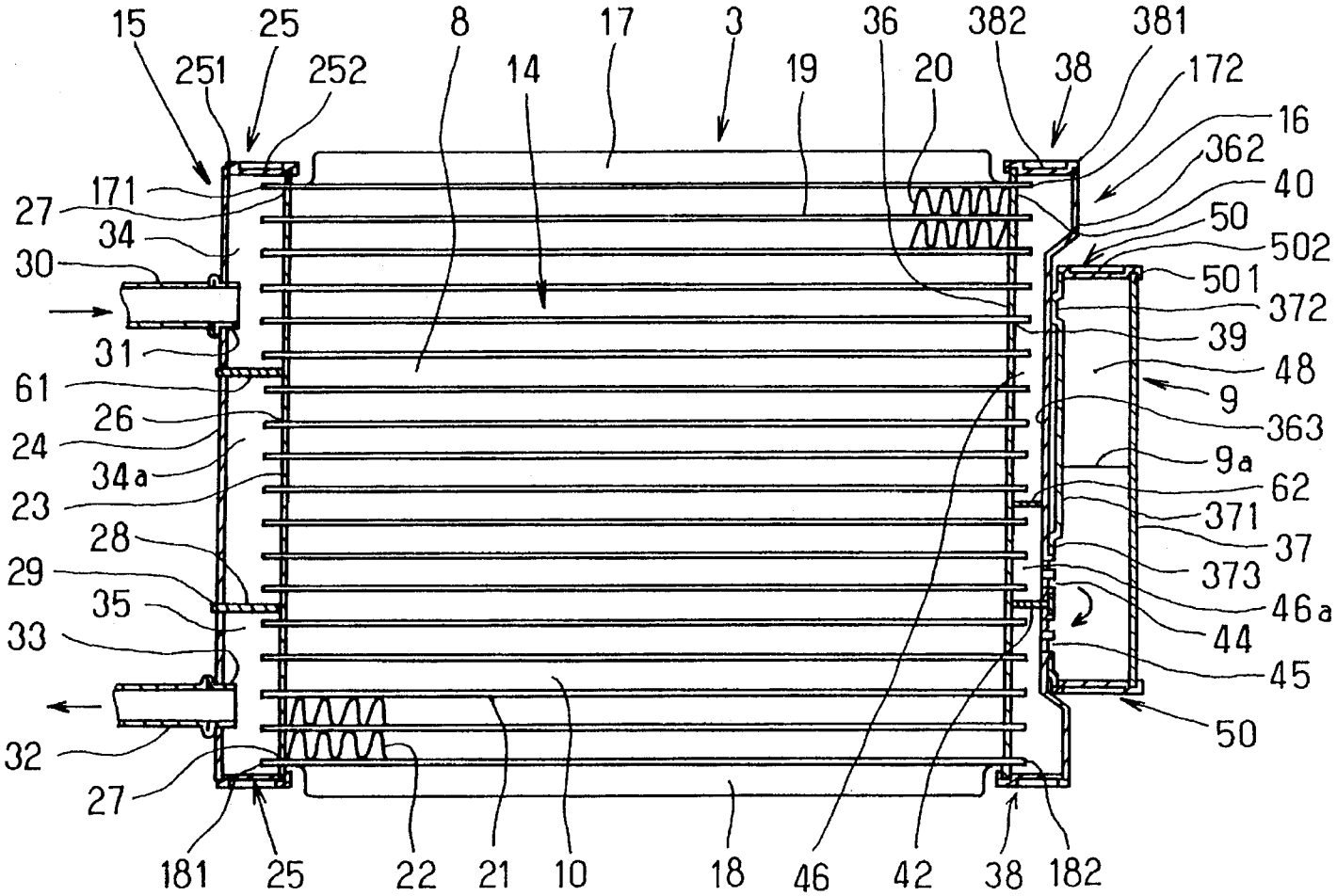
FIG. 14 is a cross-sectional view illustrating the condenser of the eighth embodiment of the present invention.

FIG. 14 illustrates the sixth embodiment according to the present invention, i.e., a receiver-integrated refrigerant condenser. In this embodiment, in the first header 15 and the second header 16 are provided a third separator 61 and a fourth separator 62 respectively to partition the chamber communicated with the plurality of condensing tubes 19 composing the condensing part 8 and add an intermediate communication chamber 34*a* and an upstream side communication chamber 46*a* respectively. In this arrangement, the refrigerant makes S-turn flow within the condensing part 8.

Incidentally, the number of turns of refrigerant flow within the condensing part 8 may be increased by increasing the number of separators.

(Ninth Embodiment)

Figure 15:
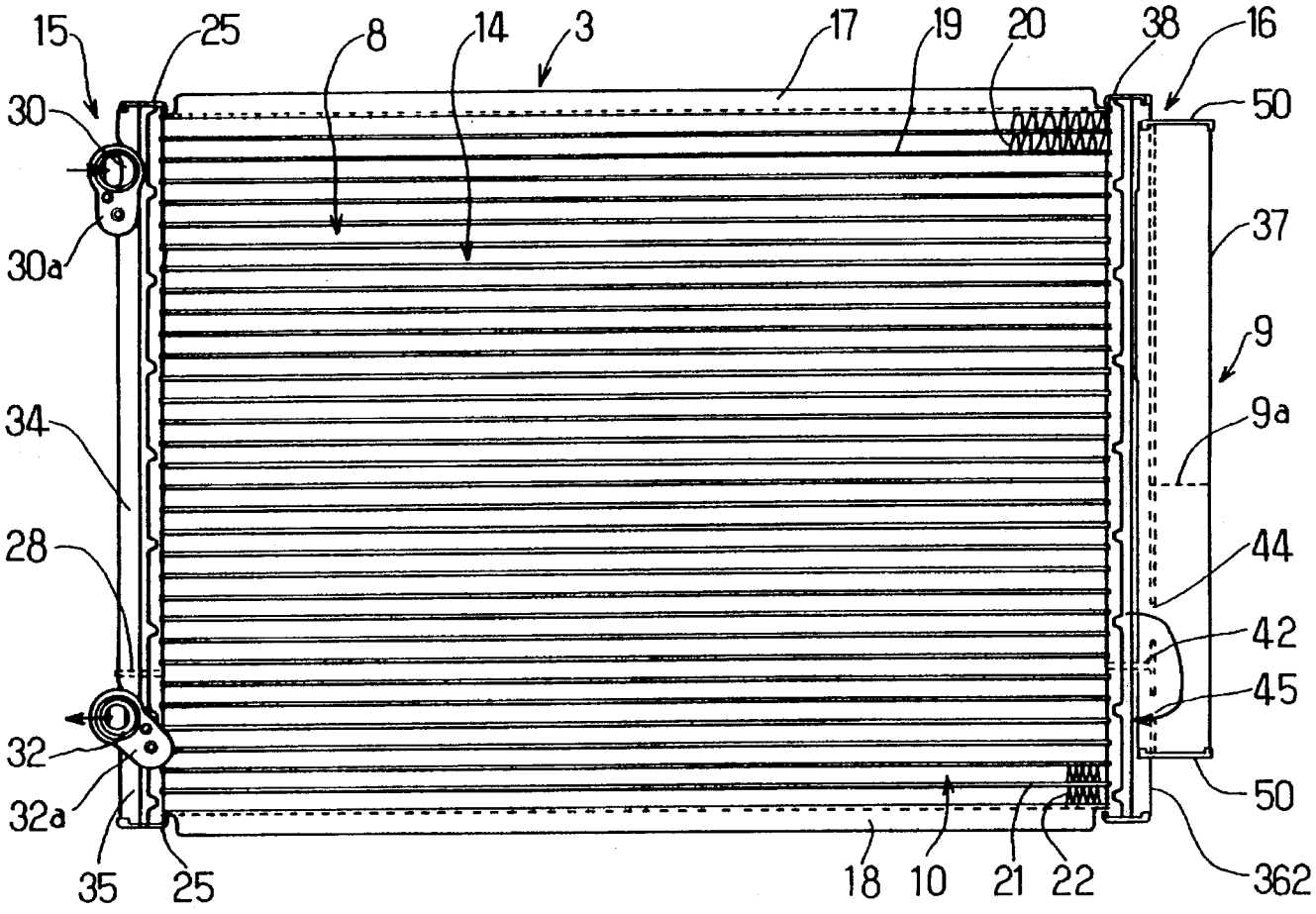
FIG. 15 is a front view illustrating the condenser of the ninth embodiment according to the present invention.

FIG. 15 illustrates the ninth embodiment according to the present invention. In this embodiment, the inlet pipe 30 and outlet pipe 32 provided in the first embodiment are modified. The inlet pipe 30 and the outlet pipe 32 are formed integrally with aluminum pipe joints 30*a* and 32*a* respectively. These joints 30*a* and 32*a* are joined by brazing to the first header 15 so that the refrigerant pipe 7 illustrated in FIG. 1 can be connected to the joints 30*a* and 32*a*. In this case, the inlet pipe 30 and the outlet pipe 32 are opened in such a direction that the refrigerant pipe 7 can be connected thereto in the depth direction of the condenser (forward and backward directions of a vehicle) to further save the installation space within the engine room.

(Tenth Embodiment)

Figure 16:
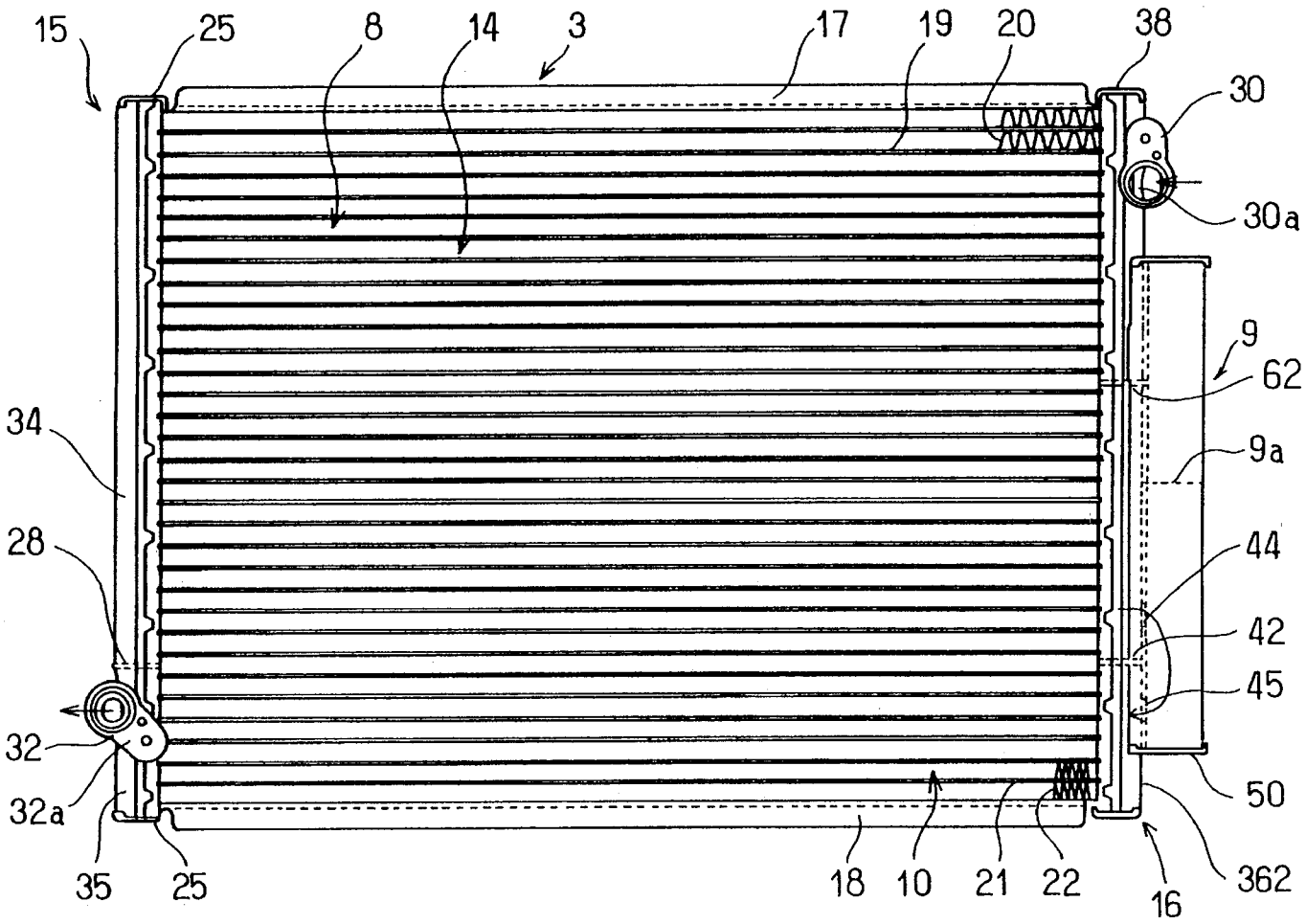
FIG. 16 is a front view illustrating the condenser of the tenth embodiment according to the present invention.

FIG. 16 illustrates the tenth embodiment according to the present invention. In this embodiment, the inlet pipe 30 is provided to the second header 16 on the side provided with the receiving part 9. The inlet pipe 30 is formed integrally with the pipe joint 30*a* like the above ninth embodiment and joined by brazing to the second header 16.

From the viewpoint of increasing the degree of freedom of mountability on various vehicles, it is desirable that the inlet pipe 30 and outlet pipe 32 of the refrigerant condenser 3 should be able to be attached to different headers respectively. With respect to the attachment of the inlet pipe 30 and outlet pipe 32, there are two possible variations; one is that the inlet pipe 30 is attached to the first header 15 and the outlet pipe 32 is attached to the second header 16, and the other is that the inlet pipe 30 is attached to the second header 16 and the outlet pipe 32 is attached to the first header 15. It is preferable that the number of the supercooling tubes 21 should be about 15% to 20% the number of tubes contained within the whole core 14 as described above. Therefore, if the inlet pipe 30 is attached to the first header 15 and the outlet pipe 32 is attached to the second header 16 on the side of the receiving part 9, the supercooling part 10 should have a U-turn flow and the pressure loss of the refrigerant will increase due to the small number of tubes at the supper cooling part 10. For this reason, it is rather preferable that the inlet pipe 30 should be attached to the second header 16 on the side of the receiving part 9.

In view of the above, in the tenth embodiment illustrated in FIG. 16, a separator 62 is added to the second header 16 to make a S-turn flow in the condensing part 8. The pipe joint 30*a* of the inlet pipe 30 is attached to the second header 16. In this arrangement, the outlet pipe 30 and the outlet pipe 32 can be attached to different headers respectively.

(Modifications)

In the above embodiments, the present invention is applied to an air-conditioner for a vehicle. However, the present invention may also be applied to any air-conditioner for rail cars, ship or airplanes, for example, in which the variation in the circulating refrigerant quantity is large.

Also in the above embodiments, various embodiments are described for the second header 16. However, various modifications are also possible with respect to the first header 15 in the same way.

As illustrated in FIG. 2, the vertical length of a gas-liquid separation chamber 48 is shorter than the vertical length of the combination of communication chambers 46 and 47. As a result, even in such a composition that a receiving part 9 is integrally formed at a header 16 of a condenser 3, the degree of interference of a receiving part 9 with peripheral devices of a vehicle can substantially be reduced, whereby the receiver-integrated condenser 3 can easily be installed. Accordingly, there is no need to reduce the widthwise dimension of a core 14 having a condensing part 8 and the condensing performance can easily be ensured.

Further in the embodiment in FIG. 2, the refrigerant condensed by the condensing part 8 is temporarily pooled within an upstream side communication chamber 46 and then introduced into the gas-liquid separation chamber 48 through a refrigerant introducing means 44 in the partitioning part as illustrated in FIG. 2. In this arrangement, the gas refrigerant in a state of small bubbles discharged from the condensing part 8 is collected within the upstream side communication chamber 46 and become the gas refrigerant in a state of bubbles larger in diameter and greatly influenced by buoyancy. As a result, the refrigerant can easily be separated into gas and liquid phases within the gas-liquid separation chamber 48.

Furthermore, due to the partition part, the refrigerant makes a U-turn flow while the refrigerant flows from the refrigerant introducing means 44 through the gas-liquid separation chamber 48 to the refrigerant discharging means 45. Therefore, the refrigerant is separated into gas and liquid phases by centrifugal force and the gas refrigerant in a state of bubbles concentrates more. As a result, bubbles of the gas refrigerant are joined together and become larger in diameter, whereby the gas refrigerant is greatly influenced by buoyancy and the refrigerant can easily be separated into gas and liquid phases within the gas-liquid separation chamber 48. Even if the lowest part of the condensing part 8 is positioned closely to the top part of the supercooling part 10, the partition part lengthens the passage from the downstream end of the condensing part 8 to the upstream end of the supercooling part 10. As a result, no gas refrigerant in a state of bubbles which has not been separated is sent from the gas-liquid separation chamber 48 to the supercooling part 10.

Furthermore, it is so arranged that the refrigerant flows from the refrigerant introducing means 44 into the liquid refrigerant at the lower part of the gas-liquid separation chamber 48. Therefore, even when the flow rate of the refrigerant is large, the refrigerant level **9*a*** within the gas-liquid separation chamber is not rippled. As a result, the refrigerant can suitably be separated into gas and liquid phases.

Moreover, the lower part of the gas-liquid separation chamber 48 communicates with the supercooling part 10 through the downstream side communication chamber 47. Therefore, even if the refrigerant should not completely be separated into gas and liquid phases within the gas-liquid separation chamber 48, the gas refrigerant in a state of bubbles can become extinct at the supercooling part 10.

By combining the above modes of operation, the capacity of the gas-liquid separation chamber 48, or the cross-sectional area of the gas-liquid separation chamber 48, can be reduced. As a result, the effective radiation areas of the condensing part 8 and supercooling part 10 can easily be secured.

Figure 11B:
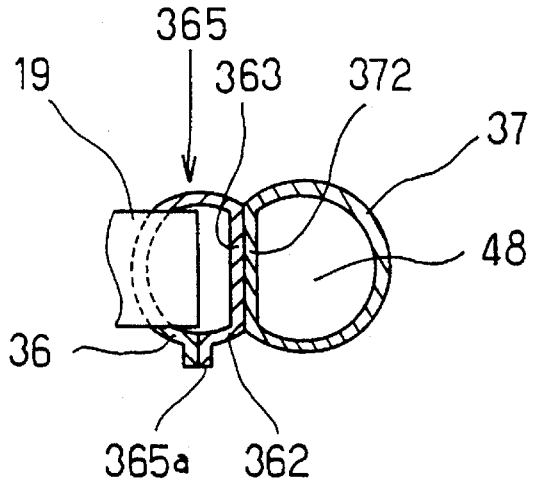
FIG. 11B is a cross-sectional view illustrating of the main part of the cylindrical body 37 and cylindrical part 365 in the assembled state.

According to the invention in FIG. 11, it is so structured that a header plate 36 and a tank plate 362 are integrally formed by bending and joining a metal plate. As a result, the cost can be reduced by reducing the number of parts and components.

Furthermore, according to the invention in FIG. 9, a tank plate 362 and a cylindrical body 37 are integrally formed by extrusion as illustrated in FIG. 9. As a result, the effects of the cost reduction achieved by reducing the number of parts and components, the reduction of leakage achieved by reducing the joining points, etc. can be obtained.

What is claimed is:

1. A receiver-integrated refrigerant condenser comprising:

a core having first and second ends and a condensing part for condensing a refrigerant flowing in a horizontal direction;

a first header extending in a vertical direction at said first end of said core and connected to an upstream end of said condensing part;

a second header extending in a vertical direction at said second end of said core and connected to a downstream end of said condensing part, said second header including therein a communication chamber in fluid communication with said condensing part, and a gas-liquid separation chamber provided beside said communication chamber within said second header for separating refrigerant into gas and liquid phases;

a refrigerant introducing means for introducing the refrigerant within said communication chamber into said gas-liquid separation chamber; and a receiving part disposed in a position lower than said refrigerant introducing means for receiving liquid refrigerant from said gas-liquid separation chamber, wherein a vertical length of said gas-liquid separation chamber is shorter than that of said second header.

2. The receiver-integrated refrigerant condenser according to claim 1, wherein said refrigerant introducing means is provided at a portion corresponding to a liquid refrigerant pool part at a lower part of said gas-liquid separation chamber for introducing the refrigerant within said communication chamber into the liquid refrigerant within said gas-liquid separation chamber.

3. The receiver-integrated refrigerant condenser according to claim 1, wherein said refrigerant introducing means is provided below a liquid surface of a liquid refrigerant in said gas-liquid separation chamber in at least normal condition.

4. The receiver-integrated refrigerant condenser according to claim 1, wherein it is so arranged that an upper end of said gas-liquid separation chamber is lower than an upper end of said communication chambers in a unit and a lower end of said gas-liquid separation chamber is higher than a lower end of said communication chambers in a unit.

5. The receiver-integrated refrigerant condenser according to claim 1, wherein said gas-liquid separation chamber is a cylindrical body which is different in material from said communication chamber and said cylindrical body is temporarily fixed to a specified structure composing of said communication chamber at at least two portions in up and down direction thereof and then is joined integrally with said specified structure by brazing.

6. The receiver-integrated refrigerant condenser according to claim 1, wherein components of said condenser are made of an aluminum material, temporarily fixed to a specified structure and then joined integrally with said specified structure by brazing.

7. A receiver-integrated refrigerant condenser comprising:

a core having first and second ends and a condensing part for condensing the refrigerant flowing in a horizontal direction;

a first header extending in a vertical direction at said first end of said core and connected to an upstream end of said condensing part;

a second header extending in a vertical direction at said second end of said core and connected to a downstream end of said condensing part, said second header including therein a communication chamber in fluid communication with said condensing part, and a gas-liquid separation chamber provided beside said communication chamber within said second header for separating refrigerant into gas and liquid phases;

a refrigerant introducing means provided at a portion corresponding to a liquid refrigerant pool part at a lower part of said gas-liquid separation chamber for introducing the refrigerant within said communication chamber into a liquid refrigerant within said gas-liquid separation chamber; and a receiving part provided at a position lower than said refrigerant introducing means within said gas-liquid separation chamber for receiving liquid refrigerant from said gas-liquid separation chamber wherein a vertical length of said gas-liquid separation chamber is shorter than that of said second header.

8. A receiver-integrated refrigerant condenser comprising:

a core having first and second ends and a condensing part disposed on an upper side thereof for condensing a refrigerant flowing in a horizontal direction and a supercooling part disposed on a lower side thereof for supercooling the refrigerant condensed by said condensing part by flowing the refrigerant in the horizontal direction;

a first header extending in a vertical direction at said first end of said core and connected to an upstream end of said condensing part;

a second header extending in a vertical direction at said second end of said core with an upper part thereof connected to a downstream end of said condensing part and a lower part thereof connected to an upstream end of said supercooling part, said second header including therein an upstream side communication chamber in fluid communication with the downstream end of said condensing part, a downstream side communication chamber provided below said upstream side communication chamber by partitioning said second header and in fluid communication with the upstream end of said supercooling part, and a gas-liquid separation chamber provided beside both said communication chambers within said second header for separating the refrigerant into gas and liquid phases;

a refrigerant introducing means provided at a lower part of said upstream side communication chamber for introducing the refrigerant from said upstream side communication chamber into a liquid refrigerant pool portion at a lower part of said gas-liquid separation chamber; and a receiving part provided at a position lower than said refrigerant introducing means for receiving liquid refrigerant from said gas-liquid separation chamber, wherein a vertical length of said gas-liquid separation chamber is shorter than that of said second header.

9. The receiver-integrated refrigerant condenser according to claim 8, wherein it is so arranged that an upper end of said gas-liquid separation chamber is lower than an upper end of said communication chambers in a unit and a lower end of said gas-liquid separation chamber is higher than a lower end of said communication chambers in a unit.

10. The receiver-integrated refrigerant condenser according to claim 8, wherein said second header comprises a header plate in and to which tube ends of said condensing part and supercooling part of said core are connected;

a tank plate connected to said header plate and composing said upstream side communication chamber and said downstream side communication chamber with said header plate;

a partition part for partitioning a space defined by said header plate and said tank plate into both said communication chambers;

a cylindrical body composing said gas-liquid separation chamber therein, connected to a side of an outer face of said header tank, and having a height smaller than that of said header plate and said tank plate, and wherein said refrigerant introducing means introduces the refrigerant within said upstream side communication chamber into a liquid refrigerant within said gas-liquid separation chamber.

11. The receiver-integrated refrigerant condenser according to claim 10, wherein joining parts of said tank plate and said cylindrical body have a flat shape.

12. The receiver-integrated refrigerant condenser according to claim 11, wherein said joining parts have flat protruding parts protruded from a part of a flat surface by step.

13. The receiver-integrated refrigerant condenser according to claim 10, wherein joining parts of said tank plate and said cylindrical body have a curved surface.

14. The receiver-integrated refrigerant condenser according to claim 10 wherein said cylindrical body is integrally formed by extrusion.

15. The receiver-integrated refrigerant condenser according to claim 10, wherein said cylindrical body is formed by bending a metal plate into a cylindrical shape.

16. The receiver-integrated refrigerant condenser according to claim 10, wherein it is so arranged that said header plate and said tank plate are integrally formed by bending and joining a metal plate into a cylindrical shape.

17. The receiver-integrated refrigerant condenser according to claim 8, said second header comprising a header plate in and to which tube ends of said condensing part and supercooling part of said core are connected;

a tank plate connected to said header plate and composing with said header plate said upstream side communication chamber and said downstream side communication chamber;

a partition part for partitioning a space defined by said header plate and said tank plate into both said communication chambers;

a cylindrical body composing said gas-liquid separation chamber therein, integrally formed with said header tank by extruding outerward from a side of said header tank connected to a side of an outer face of said header tank and having a height smaller than that of said header plate and said tank plate, and wherein said refrigerant introducing means introduces the refrigerant within said upstream side communication chamber into the liquid refrigerant within said gas-liquid separation chamber.

18. The receiver-integrated refrigerant condenser according to claim 8, further comprising a sight glass connected to a refrigerant pipe at a downstream side from said supercooling part for observing a state of refrigerant.

19. The receiver-integrated refrigerant condenser according to claim 8 or 9, wherein said gas-liquid separation chamber is a cylindrical body which is different in material from said communication chamber and said cylindrical body is temporarily fixed to a specified structure composing of said communication chamber at at least two portions in up and down direction thereof and then is joined integrally with said specified structure by brazing.

20. The receiver-integrated refrigerant condenser according to claim 19, further comprising:

at least one claw disposed to protrude toward said cylindrical body at a periphery portion of one of said refrigerant introducing means and said receiving part to achieve one part of a fixing portion between said cylindrical body and said communication chamber; and a partition part for partitioning an inside of said communication chamber into two parts and having a protrusion portion protruding toward said cylindrical body to achieve the other part of said fixing portion.

21. The receiver-integrated refrigerant condenser according to claim 8, wherein components of said condenser are made of an aluminum material, temporarily fixed to a specified structure and then joined integrally with said specified structure by brazing.

22. A receiver-integrated refrigerant condenser comprising:

a core having first and second ends and a condensing part disposed on an upper side thereof for condensing refrigerant flowing in a horizontal direction and a supercooling part disposed on a lower side thereof for supercooling the refrigerant condensed by said condensing part by flowing the refrigerant in the horizontal direction;

a first header extending in a vertical direction at said first end of said core and connected to an upstream end of said condensing part;

a second header extending in a vertical direction at said second end of said core with an upper part thereof connected to a downstream end of said condensing part and a lower part thereof connected to an upstream end of said supercooling part, said second header including therein an upstream side communication chamber in fluid communication with said condensing part, a downstream side communication chamber provided below said upstream side communication chamber by partitioning said second header and in fluid communication with the upstream end of said supercooling part, and a gas-liquid separation chamber provided beside both said communication chambers within said second header for separating refrigerant into gas and liquid phases;

a refrigerant introducing means provided at an upper part of said upstream side communication chamber for introducing refrigerant from said upstream side communication chamber into a gas refrigerant at an upper part of said gas-liquid separation chamber; and a receiving part provided at a position lower than said refrigerant introducing means for receiving liquid refrigerant from said gas-liquid separation chamber wherein a height of said gas-liquid separation chamber is shorter than that of a total height of said upstream side communication chamber and said downstream side communication chamber.

* * * * *